US012358745B2

(12) United States Patent
Schnappenberger et al.

(10) Patent No.: US 12,358,745 B2
(45) Date of Patent: Jul. 15, 2025

(54) ROLL EXCHANGE CHAMBER, ROLL-TO-ROLL PROCESSING SYSTEM AND METHOD OF CONTINUOUSLY PROVIDING A FLEXIBLE SUBSTRATE

(71) Applicant: Elevated Materials US LLC, Santa Clara, CA (US)

(72) Inventors: Frank Schnappenberger, Johannesberg (DE); Thomas Leipnitz, Alzenau (DE)

(73) Assignee: Elevated Materials US LLC, Santa Clara, CA (US)

( * ) Notice: Subject to any disclaimer, the term of this patent is extended or adjusted under 35 U.S.C. 154(b) by 186 days.

(21) Appl. No.: 18/029,860

(22) PCT Filed: Nov. 5, 2020

(86) PCT No.: PCT/EP2020/081161
§ 371 (c)(1),
(2) Date: Mar. 31, 2023

(87) PCT Pub. No.: WO2022/096107
PCT Pub. Date: May 12, 2022

(65) Prior Publication Data

US 2023/0406663 A1 Dec. 21, 2023

(51) Int. Cl.
*B65H 19/18* (2006.01)

(52) U.S. Cl.
CPC . *B65H 19/1873* (2013.01); *B65H 2301/4631* (2013.01)

(58) Field of Classification Search
CPC ..... B65H 19/1857; B65H 19/1873; B65H 2301/4631; B65H 2301/5114
See application file for complete search history.

(56) References Cited

U.S. PATENT DOCUMENTS 8,616,488 B2 * 12/2013 Wenk ..... B65H 23/0328 242/534.1
2003/0180554 A1 9/2003 Inokuti
(Continued)

FOREIGN PATENT DOCUMENTS

CN 104651799 A 5/2015
CN 106222627 A 12/2016
(Continued)

OTHER PUBLICATIONS

International Search Report and Written Opinion for International Application No. PCT/EP2020/081161 dated Mar. 20, 2023.
(Continued)

*Primary Examiner* — Sang K Kim
(74) *Attorney, Agent, or Firm* — Lee & Hayes, P.C.

(57) ABSTRACT

A roll exchange chamber for exchanging a substrate roll is described. The roll exchange chamber includes a rotatable base construction being rotatable around a central axis. The base construction comprises a first roll holder for holding a first substrate roll, a second roll holder for holding a second substrate roll, and a wall for providing a first compartment and a second compartment in the roll exchange chamber. The wall is arranged between the first roll holder and the second roll holder. Further, a roll-to-roll processing system with a roll exchange chamber as well as a method of continuously providing a flexible substrate in a roll-to-roll processing system are described.

20 Claims, 5 Drawing Sheets

(56) References Cited

U.S. PATENT DOCUMENTS

| | | | | |
|---|---|---|---|---|
| 2009/0188961 | A1* | 7/2009 | Nakagame | B65H 27/00 226/97.1 |
| 2020/0318233 | A1* | 10/2020 | Haberkorn | C23C 14/3435 |
| 2021/0114832 | A1* | 4/2021 | Morrison | B65H 18/16 |
| 2021/0222288 | A1* | 7/2021 | Kurthen | C23C 14/0605 |
| 2022/0356028 | A1* | 11/2022 | Sauer | H01L 21/67706 |

FOREIGN PATENT DOCUMENTS

| | | | |
|---|---|---|---|
| CN | 208008129 | U | 10/2018 |
| EP | 3695914 | A1 | 8/2020 |
| JP | 2005185884 | A | 7/2005 |

OTHER PUBLICATIONS

Office Action for Chinese Application No. 202080106919.2, dated Mar. 26, 2025, 20 pages.

* cited by examiner

ROLL EXCHANGE CHAMBER, ROLL-TO-ROLL PROCESSING SYSTEM AND METHOD OF CONTINUOUSLY PROVIDING A FLEXIBLE SUBSTRATE

TECHNICAL FIELD

Embodiments of the present disclosure relate to a processing system for processing a flexible substrate, particularly a roll-to-roll processing system. In particular, embodiments of the present disclosure relate to vacuum processing systems having a special chamber for exchanging a substrate roll.

BACKGROUND

Processing of flexible substrates, such as plastic films or foils, is in high demand in the packaging industry, semiconductor industries and other industries. Processing may consist of coating a flexible substrate with a material, such as a metal, a semiconductor and a dielectric material, etching and other processing actions conducted on a substrate for the respective applications. Systems performing this task typically include a coating drum, e.g. a cylindrical roller, coupled to a processing system with a roller assembly for transporting the substrate, and on which at least a portion of the substrate is coated.

For example, a coating process such as a CVD process, a PVD process or an evaporation process can be utilized for depositing thin layers onto flexible substrates. Roll-to-roll deposition apparatuses are understood in that a flexible substrate of a considerable length, such as one kilometer or more, is uncoiled from a supply spool, coated with a stack of thin layers, and recoiled again on a wind-up spool. In particular, in the manufacture of thin film batteries, e.g. lithium batteries, the display industry and the photovoltaic (PV) industry, roll-to-roll deposition systems are of high interest. For example, the increasing demand for flexible touch panel elements, flexible displays, and flexible PV modules results in an increasing demand for depositing suitable layers in roll-to-roll-coaters.

There is a continuous demand for improved roll-to-roll processing systems, particularly with respect to processing quality, processing time, and processing efficiency. For example, one aspect affecting the processing efficiency is the time required for exchanging the substrate supply spool and the substrate wind-up spool. In conventional roll-to-roll processing systems, typically processing has to be stopped for exchanging the substrate spools. For instance, conventionally, the time for exchanging the substrate spools can take up to one hour. In particular, in vacuum processing systems according to the state of the art, the vacuum chambers with the substrate spools have to be vented for exchanging the substrate spools, which increases the downtime of the processing system.

Accordingly, in view of the above, there is a demand to provide solutions with which at least some of the disadvantages of the state of the art can be reduced or overcome.

SUMMARY

In light of the above, a roll exchange chamber for exchanging a substrate roll, a roll-to-roll processing system, and a method of continuously providing a flexible substrate in a roll-to-roll processing system according to the independent claims are provided. Further aspects, advantages, and features are apparent from the dependent claims, the description, and the accompanying drawings.

According to an aspect of the present disclosure, a roll exchange chamber for exchanging a substrate roll is provided. The roll exchange chamber includes a rotatable base construction being rotatable around a central axis. The base construction includes a first roll holder for holding a first substrate roll, a second roll holder for holding a second substrate roll, and a wall for providing a first compartment and a second compartment in the roll exchange chamber. The wall is arranged between the first roll holder and the second roll holder.

According to a further aspect of the present disclosure, a roll-to-roll processing system for processing a flexible substrate is provided. The roll-to-roll processing system includes one or more vacuum chambers including at least one processing chamber. The at least one processing chamber includes a deposition unit for depositing material on the flexible substrate. Further, the roll-to-roll processing system includes a roll exchange chamber for exchanging a substrate roll. The roll exchange chamber includes a rotatable base construction being rotatable around a central axis. The base construction includes a first roll holder for holding a first substrate roll, a second roll holder for holding a second substrate roll, and a wall for providing a first compartment and a second compartment in the roll exchange chamber. The wall is arranged between the first roll holder and the second roll holder. In particular, the roll exchange chamber is a roll exchange chamber according to any of the embodiments described herein.

According to another aspect of the present disclosure, a method of continuously providing a flexible substrate in a roll-to-roll processing system is provided. The method includes exchanging an empty first substrate roll provided in a first compartment of a roll exchange chamber with a second substrate roll with a wound-up flexible substrate. Exchanging includes rotating a rotatable base construction around a central axis such that the first substrate roll coupled with a first roll holder of the base construction is transferred to a second compartment of the roll exchange chamber and the second substrate roll coupled with a second roll holder of the base construction is transferred to the first compartment. Further, the method includes connecting a trailing end of a flexible substrate unwound from the first substrate roll with a leading end of the flexible substrate provided on the second substrate roll.

Embodiments are also directed at apparatuses for carrying out the disclosed methods and include apparatus parts for performing each described method aspect. These method aspects may be performed by way of hardware components, a computer programmed by appropriate software, by any combination of the two or in any other manner. Furthermore, embodiments according to the disclosure are also directed at methods for operating the described apparatus. The methods for operating the described apparatus include method aspects for carrying out every function of the apparatus.

BRIEF DESCRIPTION OF THE DRAWINGS

So that the manner in which the above recited features of the present disclosure can be understood in detail, a more particular description of the disclosure, briefly summarized above, may be had by reference to embodiments. The accompanying drawings relate to embodiments of the disclosure and are described in the following.

DETAILED DESCRIPTION OF EMBODIMENTS

Reference will now be made in detail to the various embodiments of the disclosure, one or more examples of which are illustrated in the figures. Within the following description of the drawings, same reference numbers refer to same components. Only the differences with respect to individual embodiments are described. Each example is provided by way of explanation of the disclosure and is not meant as a limitation of the disclosure. Further, features illustrated or described as part of one embodiment can be used on or in conjunction with other embodiments to yield yet a further embodiment. It is intended that the description includes such modifications and variations.

Figure 1:
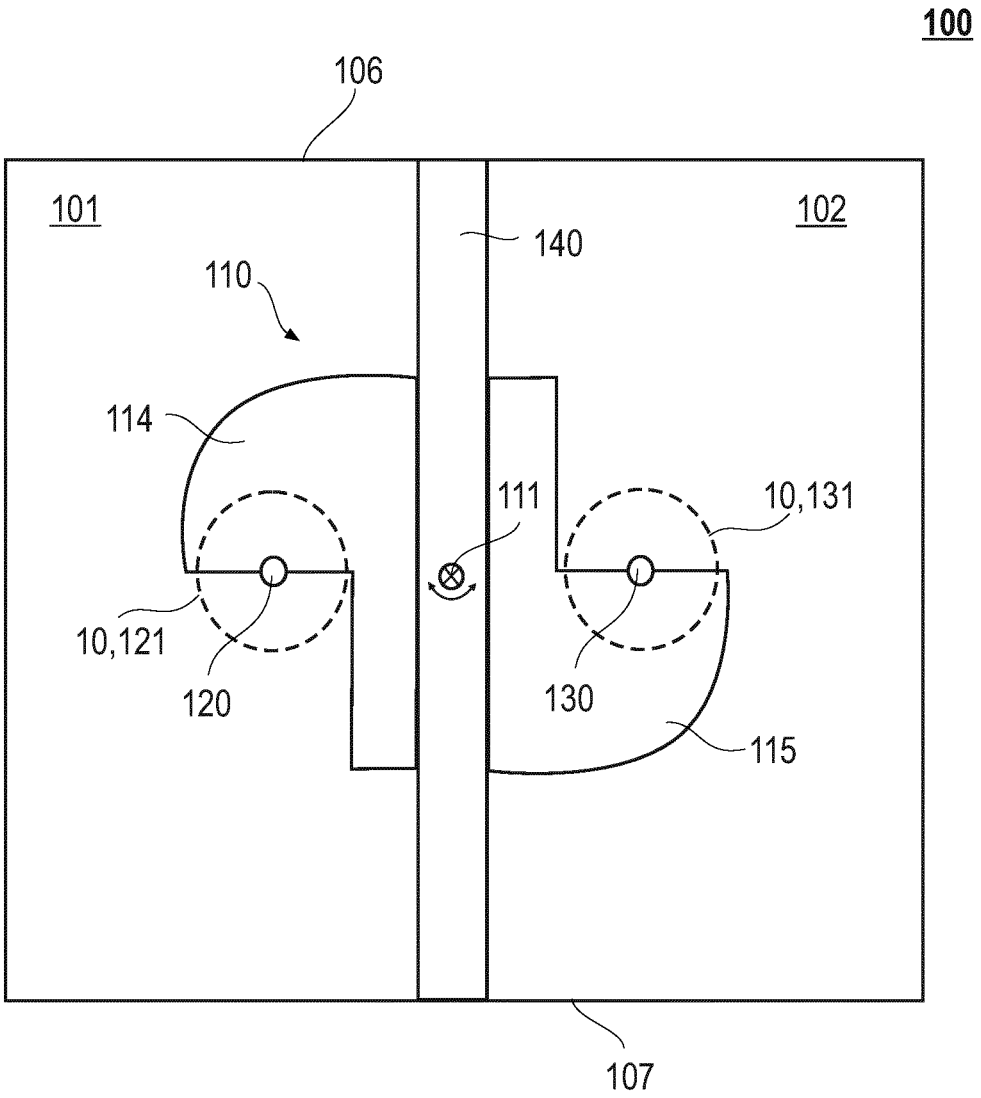
FIG. 1 shows a schematic view of a roll exchange chamber for exchanging a substrate roll according to embodiments described herein.

With exemplary reference to FIG. 1, a roll exchange chamber 100 for exchanging a substrate roll 10 according to the present disclosure is described. According to embodiments, which can be combined with any other embodiments described herein, the roll exchange chamber 100 includes a rotatable base construction 110 being rotatable around a central axis 111. Typically, the central axis 111 is a horizontal axis. As indicated by the double-sided arrow in FIG. 1, the base construction 110 may be rotatable in a clockwise or anti-clockwise direction. The base construction 110 includes a first roll holder 120 and a second roll holder 130. The first roll holder 120 is configured for holding a first substrate roll 121. The second roll holder 130 is configured for holding a second substrate roll 121. The first substrate roll 121 and the second substrate roll 131 are indicated in dotted lines. Further, the base construction 110 includes a wall 140 for providing a first compartment 101 and a second compartment 102 in the roll exchange chamber 100. The wall 140 is arranged between the first roll holder 120 and the second roll holder 130. As exemplarily shown in FIG. 1, the base construction 110 may be point symmetrical with respect to the central axis 111.

In particular, the wall 140 of the base construction 110 is configured such that the wall 140 may extend from an upper chamber wall 106 to a bottom chamber wall 107 for providing a first compartment 101 and a second compartment 102 within the roll exchange chamber 100.

More specifically, the first compartment 101 and the second compartment 102 can be provided by the wall 140 of the base construction 110 when the wall 140 is in a vertical orientation. In other words, when the wall 140 is in the vertical orientation, the interior space of the roll exchange chamber 100 can be separated by the wall 140 into a first compartment 101 and a second compartment 102. Typically, the first compartment 101 and the second compartment 102 can be separated by the wall 140 in an air-tight manner.

As exemplarily shown in FIG. 1, the first roll holder 120 and the second roll holder 130 are typically connected to the wall 140. For instance, the first roll holder 120 can be connected to the wall 140 via a first mechanical structure 114. The second roll holder 130 can be connected to the wall 140 via a second mechanical structure 115. Accordingly, it is to be understood that upon rotation of the base construction 110, the wall 140, first roll holder 120 and the second roll holder 130 are rotated.

Figure 2A:
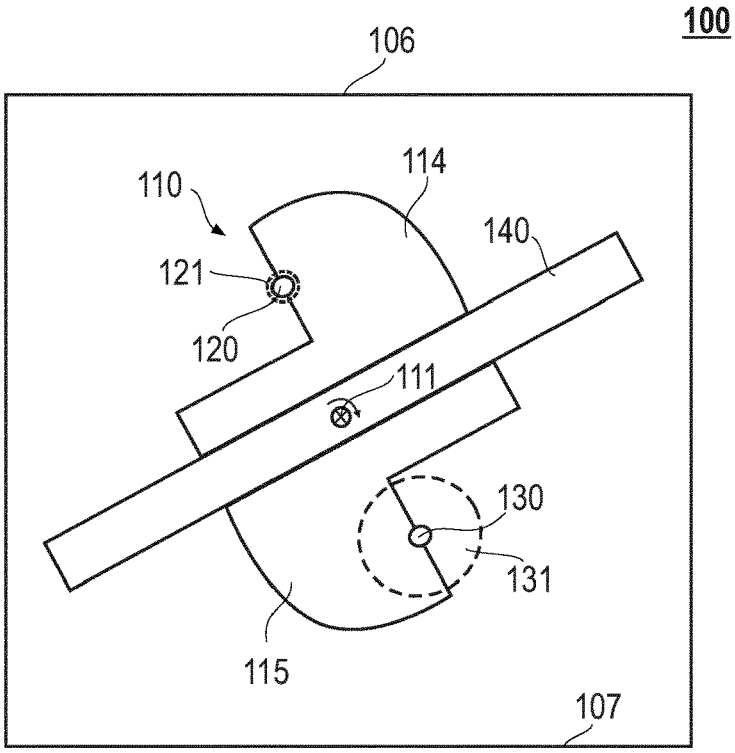
FIG. 2A shows a schematic view of a roll exchange chamber according to embodiments described herein during rotation of the base construction.
Figure 2B:
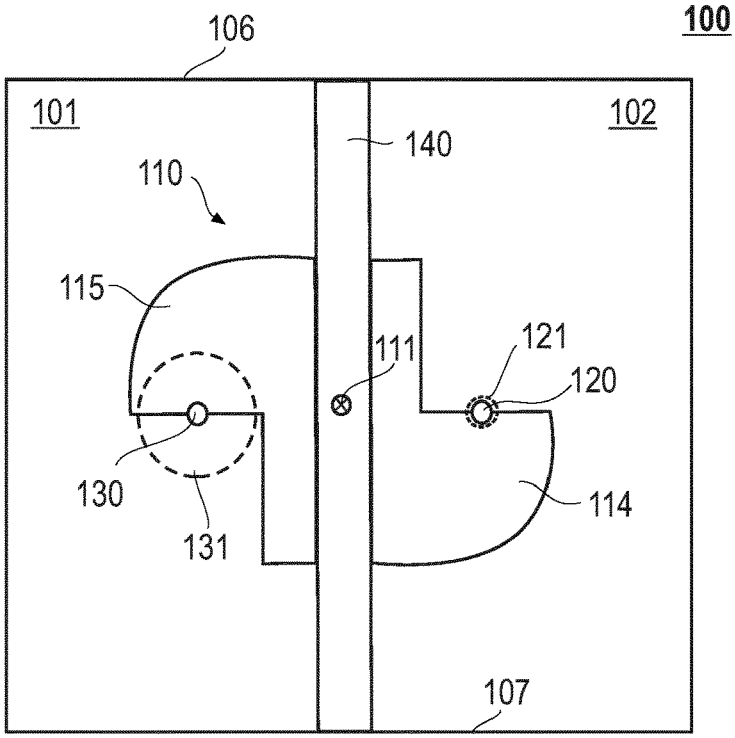
FIG. 2B shows a schematic view of a roll exchange chamber according to embodiments described herein after rotation of the base construction.

FIG. 2A shows a schematic view of a roll exchange chamber 100 during rotation of the base construction 110 in a clockwise direction. FIG. 2B shows the roll exchange chamber 100 after rotation of the base construction by 180° compared to the position of the base construction 110 shown in FIG. 1. Further, FIGS. 2A and 2B show an example in which the first substrate roll 121 is empty, i.e. the flexible substrate has been unwound from the first substrate roll 121, and the second substrate roll 131 is full, i.e. the flexible substrate is wound on the second substrate roll 131. The empty first substrate roll 121 is schematically illustrated by a smaller diameter compared to the full second substrate roll 131.

Accordingly, from FIGS. 1, 2A and 2B, it is to be understood that the roll exchange chamber 100 is configured such that by rotating the rotatable base construction 110, an empty first substrate roll 121 can be exchanged with a second substrate roll 131 with a wound-up flexible substrate.

Accordingly, compared to the state of the art, the roll exchange chamber 100 according to embodiments described herein beneficially provides for a significant reduction in roll exchange time, i.e. the time needed to replace an empty substrate roll with a new substrate roll with a wound-up substrate. Further, the roll exchange chamber as described herein has the advantage that the substrate roll exchanged can be automated and carried out under vacuum conditions.

Before various further embodiments of the present disclosure are described in more detail, some aspects with respect to some terms used herein are explained.

In the present disclosure, a "roll exchange chamber" can be understood as a chamber configured for exchanging a roll, particularly a substrate roll. A "substrate roll" can be understood as a roll configured for carrying a flexible substrate wound on the roll. A "flexible substrate" can be understood as a bendable substrate. The term "flexible substrate" or "substrate" may be synonymously used with the term "foil" or the term "web". In particular, it is to be understood that embodiments of the roll exchange chamber and of the roll-to-roll processing system described herein can be utilized for any kind of flexible substrate. For example, a flexible substrate as described herein may include materials like PET, HC-PET, PE, PI, PU, TaC, OPP, CPP, one or more metals (e.g. copper or aluminium), paper, combinations thereof, and already coated substrates like Hard Coated PET (e.g. HC-PET, HC-TaC) or metal coated polymeric substrates (e.g. copper coated PET) and the like. According to an example, the substrate may be a metal foil, e.g. a foil consisting of copper or other metals. For example, the substrate thickness can be 2 μm or more and 1 mm or less. The substrate can be transparent or non-transparent.

In the present disclosure, a "rotatable base construction" can be understood as a rigid mechanical structure or assembly which is rotatably mounted on one or more bearings. In particular, the base construction is rotatably mounted on one or more bearings such that the base construction can be rotated around a central axis, particularly a horizontal central axis.

In the present disclosure, a "roll holder for holding a substrate roll" can be understood as a holding device configured for holding a substrate roll as described herein. For instance, the roll holder may include a bolt or a shaft on which the substrate roll can be mounted. Further, the roll holder may include a coupling device, particularly an automated coupling device, for coupling the substrate roll with the roll holder. Typically, the roll holder is rotatably mounted, particularly around a central axis of the roll holder. Accordingly, it is to be understood that by rotating the roll holder, the flexible substrate wound on the substrate roll can be unwound.

In the present disclosure, a "substrate roll" can be understood as a roll configured for carrying a flexible substrate. Accordingly, an "empty" substrate roll can be understood as a substrate roll without a flexible substrate and a "full" substrate roll can be understood as a substrate roll with a wound-up flexible substrate.

In the present disclosure, a "wall for providing a first compartment and a second compartment in the roll exchange chamber" can be understood as a wall which is configured such that the roll exchange chamber can be divided into a first compartment and a second compartment. In other words, the wall may separate the first compartment from the second compartment, particularly in an air-tight manner.

Figure 3:
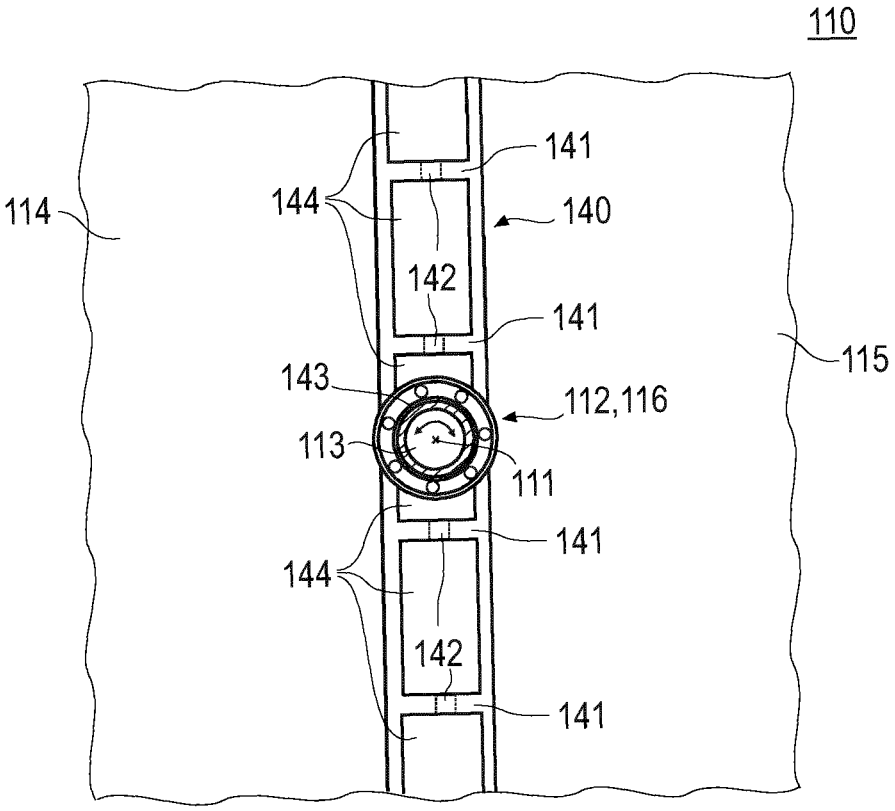
FIG. 3 shows a schematic view of a section of a rotatable base construction according to embodiments described herein.
Figure 4:
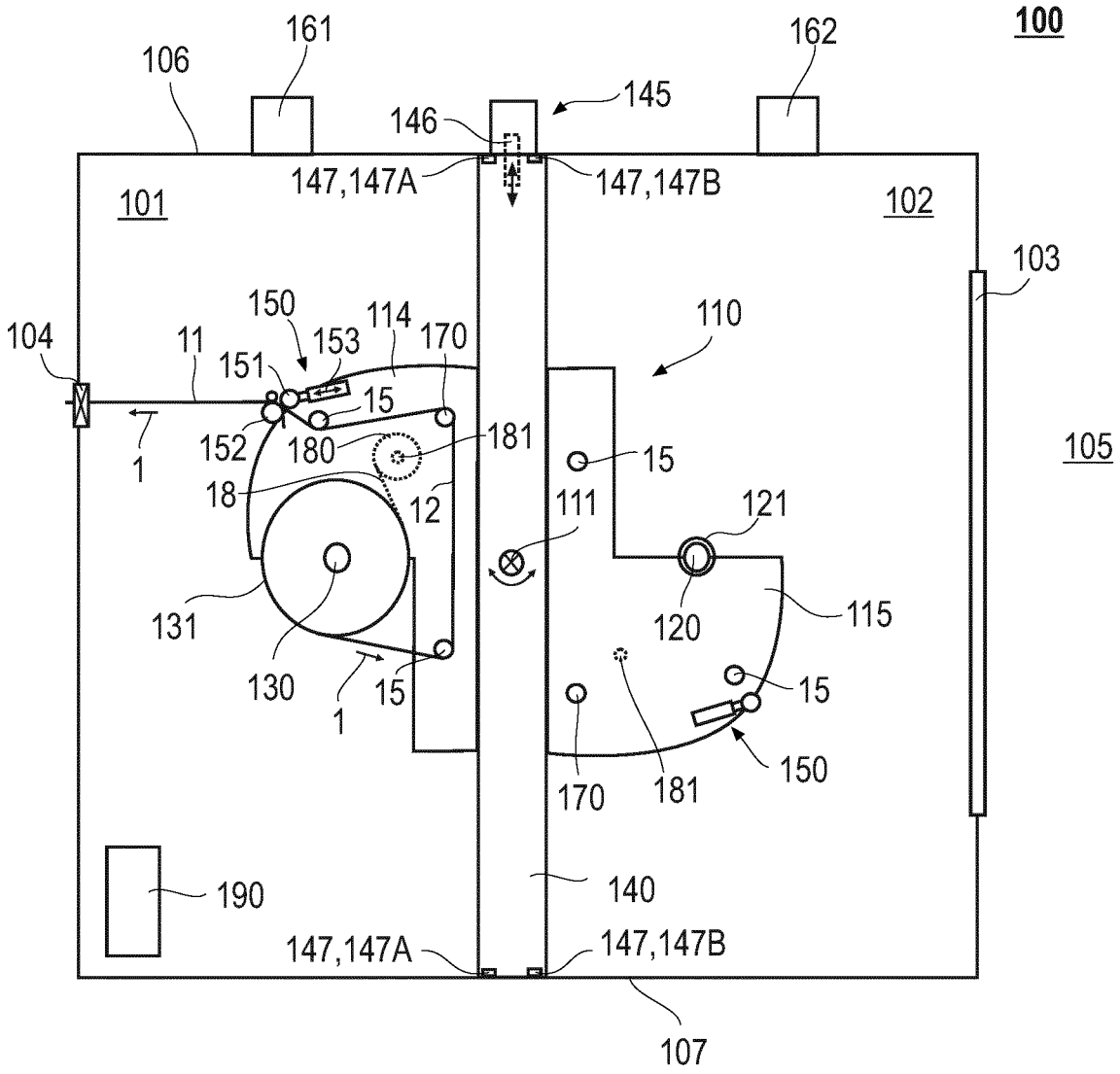
FIG. 4 shows a schematic view of a roll exchange chamber according to further embodiments described herein.

With exemplary reference to FIGS. 3 and 4, further embodiments of the roll exchange chamber 100 are described.

FIG. 3 shows a schematic view of a section of the rotatable base construction 110 according to embodiments described herein. According to embodiments, which can be combined with any other embodiments described herein, the rotatable base construction 110 is mounted on a central bearing unit 112 having a feedthrough 113 for supply lines. For example, the feedthrough 113 may be provided in a bolt 143 mounted to the wall 140. As exemplarily shown in FIG. 3, the central bearing unit 112 may include a ball bearing 116. Typically, the ball bearing 116 is mounted on the bolt 143. However, it is to be understood that alternatively other bearings, e.g. a slide bearing may be implemented. Further, it is to be understood that the central bearing unit 112 provides for the possibility to rotate the base construction 110.

As exemplarily shown in FIG. 3, according to embodiments which can be combined with any other embodiments described herein, the wall 140 has an interior hollow space 144. The interior hollow space 144 may be provided with one or more ribs 141. The one or more ribs 141 may include one or more openings 142 for supply lines. The supply lines may include one or more of power cables, data cables and tubes for media supply. The supply lines can for example be used to supply the motors, actuators, rollers, measurement devices etc. provided in the roll exchange chamber 100.

Providing a central bearing unit 112 with a feedthrough 113 and one or more ribs with one or more openings 142 for supply lines as described herein, provides for an improved supply line connection to motors, actuators, rollers, measurement devices etc. mounted to the rotatable base construction 110.

Further, it is to be noted that providing a wall 140 with an interior hollow space 144 has the advantage that a vacuum may be provided inside the wall, which can be beneficial for reducing particle contamination within the roll exchange chamber 100. For example, for providing a vacuum in the interior hollow space 144 of the wall 140, a vacuum pump connection may be provided above and/or below the wall 140, i.e. in the upper chamber wall 106 and/or the bottom chamber wall 107.

According to embodiments, which can be combined with any other embodiments described herein, the roll exchange chamber 100 further includes a locking mechanism 145 for engaging with the wall 140. The locking mechanism 145 is configured for locking a position of the rotatable base construction 110. In particular, the locking mechanism 145 may include a locking bolt 146 configured for engaging with a corresponding reception provided in the wall 140. As exemplarily indicated by the double sided arrow in FIG. 4, the locking bolt 146 may be connected to a linear actuator for translating the locking bolt 146 for locking and unlocking.

With exemplary reference to FIG. 4, according to embodiments, which can be combined with any other embodiments described herein, one or more inflatable seals 147 may be provided for providing an airtight sealing between the wall 140 of the base construction 110 and the roll exchange chamber. In particular, the one or more inflatable seals 147 are arranged and configured for providing an airtight sealing between the outer surface of the wall 140 and the opposite interior surface of the roll exchange chamber 100. According to an example as shown in FIG. 4, a first inflatable seal 147A may be provided at a first compartment side and a second inflatable seal 147B may be provided at a second compartment side. In particular, it is to be understood that the first inflatable seal 147A and the second inflatable seal 147B can be arranged and configured for providing a sealing of the interior hollow space 144 of the wall 140 (as exemplarily described with reference to FIG. 3) from the first compartment 101 and the second compartment 102, respectively. Accordingly, different pressure conditions can be provided in the first compartment 101, the interior hollow space 144 of the wall 140, and the second compartment 102. It is to be understood that typically for rotating the rotatable base construction 110 the one or more inflatable seals 147 are deflated.

According to embodiments, which can be combined with any other embodiments described herein, the roll exchange chamber further includes one or more first vacuum pumps 161 for providing vacuum conditions in the first compartment 101. Additionally, the roll exchange chamber can include one or more second vacuum pumps 162 for providing vacuum conditions in the second compartment 102. The term "vacuum", as used herein, can be understood in the sense of a technical vacuum having a vacuum pressure of less than, for example, 10 mbar. Typically, the pressure in a vacuum chamber as described herein may be between $10^{-5}$ mbar and about $10^{-8}$ mbar, more typically between $10^{-5}$ mbar and $10^{-7}$ mbar, and even more typically between about $10^{-6}$ mbar and about $10^{-7}$ mbar.

According to embodiments, which can be combined with any other embodiments described herein, the roll exchange chamber 100 includes a substrate connecting device 150 for connecting a first end of a first flexible substrate 11 with a second end of a second flexible substrate 12. In particular, the substrate connecting device 150 can be a splice unit. For example, the substrate connecting device 150 may include a roller 151 with a splice tape. The roller 151 of the substrate connecting device 150 may also be referred to as a splice roller. Typically, the roller 151 of the substrate connecting device 150 is connected to a linear actuator 153 for pushing the roller 151 with the splice tape onto the first substrate being in contact with a counter roller 152. Further, the substrate connecting device 150 may include a cutting device for cutting the splice tape after substrate connection. FIG. 4 shows an example in which a trailing end portion of the first flexible substrate 11 is connected with a leading end portion of the second flexible substrate 12 by using the substrate connecting device 150.

According to embodiments, which can be combined with any other embodiments described herein, the roll exchange chamber 100 includes a tension measuring roller 170 for measuring a substrate tension, particularly the tension measuring roller 170 being arranged upstream from the substrate connecting device 150. The tension measuring roller 170 is configured for measuring a tension of the flexible substrate during substrate transportation. In particular, providing a tension measuring roller 170 can be beneficial for identifying a situation when the substrate roll has to be exchanged. In this regard, it is to be noted that the substrate tension decreases when the substrate is almost completely unwound from the substrate roll. According to embodiments, which can be combined with any other embodiments described herein, one or more of the guide rollers 15, as exemplarily shown in FIG. 4, may be tension measuring rollers.

The terms "upstream from" and "downstream from" as used herein may refer to the position of the respective component with respect to another component along the substrate transportation path in the substrate transportation direction. For better understanding, the substrate transportation direction 1 is exemplarily indicated in FIG. 4. For instance, in FIG. 4 the second flexible substrate 12 is guided from the second substrate roll 131 to a guide roller 15, from the guide roller 15 to the tension measuring roller 170, from the tension measuring roller 170 to a further guide roller 15, from the further guide roller 15 to the counter roller 152, and so forth. Accordingly, the guide roller 15 is arranged downstream from the second substrate roll 131, the tension measuring roller 170 is arranged downstream from the guide roller 15, and the counter roller 152 is arranged downstream from the tension measuring roller 170 and the further guide roller 15. Accordingly, the second substrate roll 131 is arranged upstream from the guide roller 15, the guide roller 15 is arranged upstream from the tension measuring roller 170, and the tension measuring roller 170 is arranged upstream from the further guide roller 15 and the counter roller 152.

With exemplary reference to FIG. 4, it is to be understood that typically the base construction 110 is configured to be point symmetrical with respect to the central axis 111. Accordingly, the first mechanical structure 114 and the second mechanical structure 115 can be point symmetrical with respect to the central axis 111. Further, it is to be understood that the first roll holder 120 and the second roll holder 130 can be point symmetrical with respect to the central axis 111. The respective guide rollers 15 of the first mechanical structure 114 and the second mechanical structure 115 can be point symmetrical with respect to the central axis 111. The respective tension measuring roller 170 of the first mechanical structure 114 and the second mechanical structure 115 can be point symmetrical with respect to the central axis 111. The respective substrate connecting device 150 of the first mechanical structure 114 and the second mechanical structure 115 can be point symmetrical with respect to the central axis 111. The respective interleaf holder 181 of the first mechanical structure 114 and the second mechanical structure 115 can be point symmetrical with respect to the central axis 111.

According to embodiments, which can be combined with any other embodiments described herein, the roll exchange chamber 100 includes a door 103 for providing access to the second compartment 102 from an atmospheric maintenance space 105.

According to embodiments, which can be combined with any other embodiments described herein, the roll exchange chamber 100 includes a substrate feedthrough opening 104 for providing a substrate from the first compartment to an adjacent chamber of a substrate processing system. The substrate feedthrough opening 104 may be provided with a sealing device, e.g. a gap sluice. The sealing device may also be referred to as a load lock or a load lock valve.

With exemplary reference to FIG. 4, according to embodiments which can be combined with any other embodiments described herein, an interleaf module including an interleaf holder 181 for holding an interleaf roll 180 may be provided. Typically, the interleaf holder 181 is connected to the base construction 110. For instance, one or both of the first mechanical structure 114 and the second mechanical structure 115 may be provided with an interleaf holder 181. Providing an interleaf module has the advantage that an interleaf 18 can be provided between adjacent layers of the flexible substrate such that direct contact of one layer of the flexible substrate with an adjacent layer of the flexible substrate on the substrate roll can be avoided. Upon unwinding the flexible substrate with the interleaf from the substrate roll, the interleaf 18 can be wound on the interleaf roll 180. Accordingly, it is to be understood that, while winding the flexible substrate onto the substrate roll, an interleaf can be provided between adjacent layers of the flexible substrate wound on the substrate roll.

With exemplary reference to FIG. 4, according to embodiments which can be combined with any other embodiments described herein, the first compartment 101 of the roll exchange chamber may be equipped with a cold trap 190. The cold trap 190 can beneficial for reducing humidity inside the first compartment 101, which can be beneficial for improving the processing quality.

Figure 5:
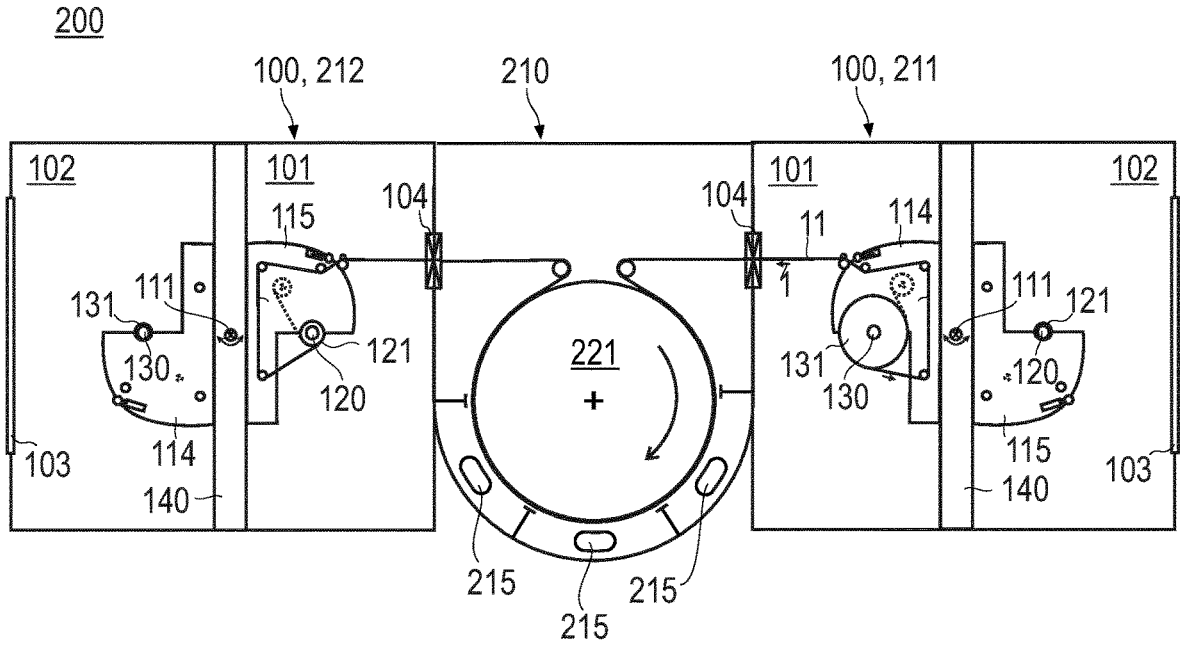
FIG. 5 shows a schematic view of a roll-to-roll processing system according to embodiments described herein.

With exemplary reference to FIG. 5, a roll-to-roll processing system 200 for processing a flexible substrate according to the present disclosure is described. More specifically, the roll-to-roll processing system can be a vacuum processing system having at least one vacuum deposition chamber. For instance, the roll-to-roll processing system may be configured for a substrate length of 500 m or more, 1000 m or more, or several kilometers. The substrate width can be 300 mm or more, particularly 500 mm or more, more particularly 1 m or more. Further, the substrate width can be 3 m or less, particularly 2 m or less.

According to embodiments, which can be combined with any other embodiments described herein, the roll-to-roll processing system 200 includes one or more vacuum chambers including at least one processing chamber 210 having one or more deposition units 215 for depositing material on the flexible substrate. Typically, the roll-to-roll processing system 200 includes a coating drum 221 configured for guiding the flexible substrate past the one or more deposition units 215.

In the present disclosure, a "coating drum" can be understood as a drum or a roller having a substrate support surface for contacting the flexible substrate. In particular, the coating drum can be rotatable about a rotation axis and may include a substrate guiding region. Typically, the substrate guiding region is a curved substrate support surface, e.g. a cylindrically symmetric surface, of the coating drum. The curved substrate support surface of the coating drum may be adapted to be (at least partly) in contact with the flexible substrate during operation of the processing system.

In the present disclosure, a "deposition unit" can be understood as a unit or device configured for depositing material on a substrate. For example, the deposition unit may be a sputter deposition unit, a CVD deposition unit, an evaporation deposition unit, a PVD or PECVD deposition unit, or another suitable deposition unit.

Further, as exemplarily shown in FIG. 5, the roll-to-roll processing system 200 includes a roll exchange chamber 100 for exchanging a substrate roll 10. The roll exchange chamber 100 includes a rotatable base construction 110 being rotatable around a central axis 111. The base construction 110 includes a first roll holder 120 and a second roll holder 130. The first roll holder 120 is configured for holding a first substrate roll 121. The second roll holder 130 is configured for holding a second substrate roll 121. Further, the base construction 110 includes a wall 140 for providing a first compartment 101 and a second compartment 102 in the roll exchange chamber 100. The wall 140 is arranged between the first roll holder 120 and the second roll holder 130. It is to be noted that the roll exchange chamber 100 can be a roll exchange chamber 100 according to any embodiments described herein.

As exemplarily shown in FIG. 5, the roll exchange chamber 100 as described herein can be employed as a substrate supply chamber 211 and as a substrate take-up chamber 212. Accordingly, from the exemplary embodiment of FIG. 5, it is to be understood that the second substrate roll 131 of the substrate supply chamber 211 can be a substrate supply roll and the first substrate roll 121 of the substrate take-up chamber 212 can be a substrate take-up roll.

Figure 6:
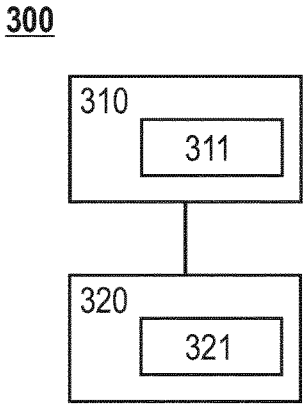
FIG. 6 shows a block diagram for illustrating a method of continuously providing a flexible substrate in a roll-to-roll processing system according to embodiments described.

With exemplarily reference to the block diagram of FIG. 6, a method 300 of continuously providing a flexible substrate in a roll-to-roll processing system is described. According to embodiments, which can be combined with any other embodiments described herein, the method includes exchanging (represented by block 310 in FIG. 6) an empty first substrate roll 121 provided in a first compartment 101 of a roll exchange chamber 100 with a second substrate roll 131 with a wound-up flexible substrate.

Exchanging the empty first substrate roll 121 with the second substrate roll 131 includes rotating (represented by block 311 in FIG. 6) a rotatable base construction 110 around a central axis 111 such that the first substrate roll 121 coupled with a first roll holder 120 of the base construction 110 is transferred to a second compartment 102 of the roll exchange chamber 100. Additionally, the second substrate roll 131 coupled with a second roll holder 130 of the base construction 110 is transferred to the first compartment 101 by rotating the rotatable base construction 110 around the central axis 111.

Further, the method includes connecting (represented by block 320 in FIG. 6) a trailing end of the flexible substrate unwound from the first substrate roll 121 with a leading end of the flexible substrate provided on the second substrate roll 131.

According to embodiments, which can be combined with any other embodiments described herein, connecting (represented by block 320 in FIG. 6) the trailing end of the flexible substrate unwound from the first substrate roll 121 with the leading end of the flexible substrate provided on the second substrate roll 131 involves using (represented by block 321 in FIG. 6) a substrate connecting device 150. In particular, the substrate connecting device 150 is a splice unit including a roller 151 with a splice tape. Further, the substrate connecting device 150 may include a cutting device cutting the splice tape.

It is to be understood that according to embodiments, which can be combined with any other embodiments described herein, the method is typically carried out by using a roll exchange chamber according any embodiments described herein.

In view of the above, it is to be understood that compared to the state of the art, embodiments of the present disclosure beneficially provide for a significant reduction in roll exchange time, i.e. the time needed to replace an empty substrate roll with a new substrate roll. Further, embodiments of the present disclosure provide the advantage that substrate roll exchange can be carried out under vacuum conditions and in an automated manner. Accordingly, embodiments as described herein provide for a reduction of processing downtimes.

While the foregoing is directed to embodiments, other and further embodiments may be devised without departing from the basic scope, and the scope is determined by the claims that follow.

The invention claimed is:

1. A roll exchange chamber for exchanging a substrate roll, comprising:

a rotatable base construction being rotatable around a central axis, the base construction comprising:

a first roll holder for holding a first substrate roll;

a second roll holder for holding a second substrate roll; and—a wall for providing a first compartment and a second compartment in the roll exchange chamber, the wall being arranged between the first roll holder and the second roll holder.

2. The roll exchange chamber of claim 1, the rotatable base construction being mounted on a central bearing unit having a feedthrough for supply lines.

3. The roll exchange chamber of claim 1, the wall having an interior hollow space comprising one or more ribs with one or more openings for supply lines.

4. The roll exchange chamber of claim 1, further comprising a locking mechanism for engaging with the wall for locking a position of the rotatable base construction.

5. The roll exchange chamber of claim 1, further comprising one or more inflatable seals for providing an airtight sealing between the wall of the base construction and the roll exchange chamber.

6. The roll exchange chamber of claim 1, further comprising one or more first vacuum pumps for providing vacuum conditions in the first compartment and one or more second vacuum pumps for providing vacuum conditions in the second compartment.

7. The roll exchange chamber of claim 1, further comprising a substrate connecting device for connecting a first end of a first flexible substrate with a second end of a second flexible substrate.

8. The roll exchange chamber of claim 7, the substrate connecting device comprising a roller with a splice tape.

9. The roll exchange chamber of claim 8, the roller being connected to a linear actuator for pushing the roller with the splice tape onto the first substrate being in contact with a counter roller.

10. The roll exchange chamber of claim 7, the substrate connecting device being a splice unit.

11. The roll exchange chamber of claim 1, further comprising a tension measuring roller for measuring a substrate tension.

12. The roll exchange chamber of claim 11, the tension measuring roller being arranged upstream of a substrate connecting device.

13. The roll exchange chamber of claim 1, further comprising a door for providing access to the second compartment from an atmospheric maintenance space.

14. The roll exchange chamber of claim 1, further comprising a substrate feedthrough opening for providing a substrate from the first compartment to an adjacent chamber of a substrate processing system.

15. A roll-to-roll processing system for processing a flexible substrate, comprising:

one or more vacuum chambers comprising at least one processing chamber having a deposition unit for depositing material on the flexible substrate; and a roll exchange chamber for exchanging a substrate roll, comprising:

a rotatable base construction being rotatable around a central axis, the base construction comprising:

a first roll holder for holding a first substrate roll;

a second roll holder for holding a second substrate roll; and a wall for providing a first compartment and a second compartment in the roll exchange chamber, the wall being arranged between the first roll holder and the second roll holder.

16. The roll-to-roll processing system of claim 15, wherein the roll exchange chamber comprises:

a rotatable base construction being rotatable around a central axis, the base construction comprising:

a first roll holder for holding a first substrate roll;

a second roll holder for holding a second substrate roll; and a wall for providing a first compartment and a second compartment in the roll exchange chamber, the wall being arranged between the first roll holder and the second roll holder.

17. A method of continuously providing a flexible substrate in a roll-to-roll processing system, the method comprising:

exchanging an empty first substrate roll provided in a first compartment of a roll exchange chamber with a second substrate roll with a wound-up flexible substrate, wherein exchanging comprises rotating a rotatable base construction around a central axis such that the first substrate roll coupled with a first roll holder of the base construction is transferred to a second compartment of the roll exchange chamber and the second substrate roll coupled with a second roll holder of the base construction is transferred to the first compartment; and connecting a trailing end of a flexible substrate unwound from the first substrate roll with a leading end of the flexible substrate provided on the second substrate roll.

18. The method of claim 17, wherein connecting the trailing end of a flexible substrate unwound from the first substrate roll with the leading end of the flexible substrate provided on the second substrate roll involves using a substrate connecting device, particularly a splice unit comprising a roller with a splice tape.

19. The method (300) of claim 17, wherein the roll exchange chamber comprises:

a rotatable base construction being rotatable around a central axis, the base construction comprising:

a first roll holder for holding a first substrate roll;

a second roll holder for holding a second substrate roll; and a wall for providing a first compartment and a second compartment in the roll exchange chamber, the wall being arranged between the first roll holder and the second roll holder.

20. Method of manufacturing a coated substrate using at least one of a roll exchange chamber, a roll-to-roll processing system, and a method of continuously providing a flexible substrate in a roll-to-roll processing system, wherein the roll exchange chamber comprises:

a rotatable base construction being rotatable around a central axis, the base construction comprising:

a first roll holder for holding a first substrate roll;

a second roll holder for holding a second substrate roll; and a wall for providing a first compartment and a second compartment in the roll exchange chamber, the wall being arranged between the first roll holder and the second roll holder, wherein the roll-to-roll processing system comprises:

one or more vacuum chambers comprising at least one processing chamber having a deposition unit for depositing material on the flexible substrate; and the roll exchange chamber, and wherein the method comprises:

exchanging an empty first substrate roll provided in a first compartment of a roll exchange chamber with a second substrate roll with a wound-up flexible substrate, wherein exchanging comprises rotating a rotatable base construction around a central axis such that the first substrate roll coupled with a first roll holder of the base construction is transferred to a second compartment of the roll exchange chamber and the second substrate roll coupled with a second roll holder of the base construction is transferred to the first compartment; and connecting a trailing end of a flexible substrate unwound from the first substrate roll with a leading end of the flexible substrate provided on the second substrate roll.

* * * * *